United States Patent [19]

Thomas

[11] 4,069,520

[45] Jan. 24, 1978

[54] ELECTRIC BIDET

[76] Inventor: R. Bert Thomas, 445 O'Farrell St. Hotel, San Francisco, Calif. 94102

[21] Appl. No.: 744,707

[22] Filed: Nov. 24, 1976

Related U.S. Application Data

[63] Continuation of Ser. No. 604,102, Aug. 13, 1975, abandoned.

[51] Int. Cl.[2] ..... A47K 11/08; A47K 3/22

[52] U.S. Cl. ..... 4/7; 4/6

[58] Field of Search ..... 4/6, 7

[56] References Cited

U.S. PATENT DOCUMENTS

| | | | |
|---|---|---|---|
| 593,527 | 11/1897 | Kustner | 4/7 |
| 2,344,561 | 3/1944 | Popil | 4/7 |
| 2,705,495 | 4/1955 | Vranna et al. | 4/7 |
| 3,288,140 | 11/1966 | McCarthy | 128/248 |
| 3,602,921 | 9/1971 | Umann | 4/7 |
| 3,812,543 | 5/1974 | Stinson | 4/7 |

*Primary Examiner*—Henry K. Artis
*Attorney, Agent, or Firm*—David E. Newhouse

[57] ABSTRACT

My invention relates to a bidet, in combination of a divided water cabinet, top from bottom, and making use of a submerged, electrical pump for water power at the syringe. This bidet, having a seat on top of said cabinet, a waste water catch tank inside the top of said cabinet and a fresh water tank in the bottom of said cabinet, with means of emptying the one and of filling the other; this bidet being portable, but portability being only one of its many improvements as the following paragraphs and drawings will reveal.

11 Claims, 3 Drawing Figures

FIG. 1.
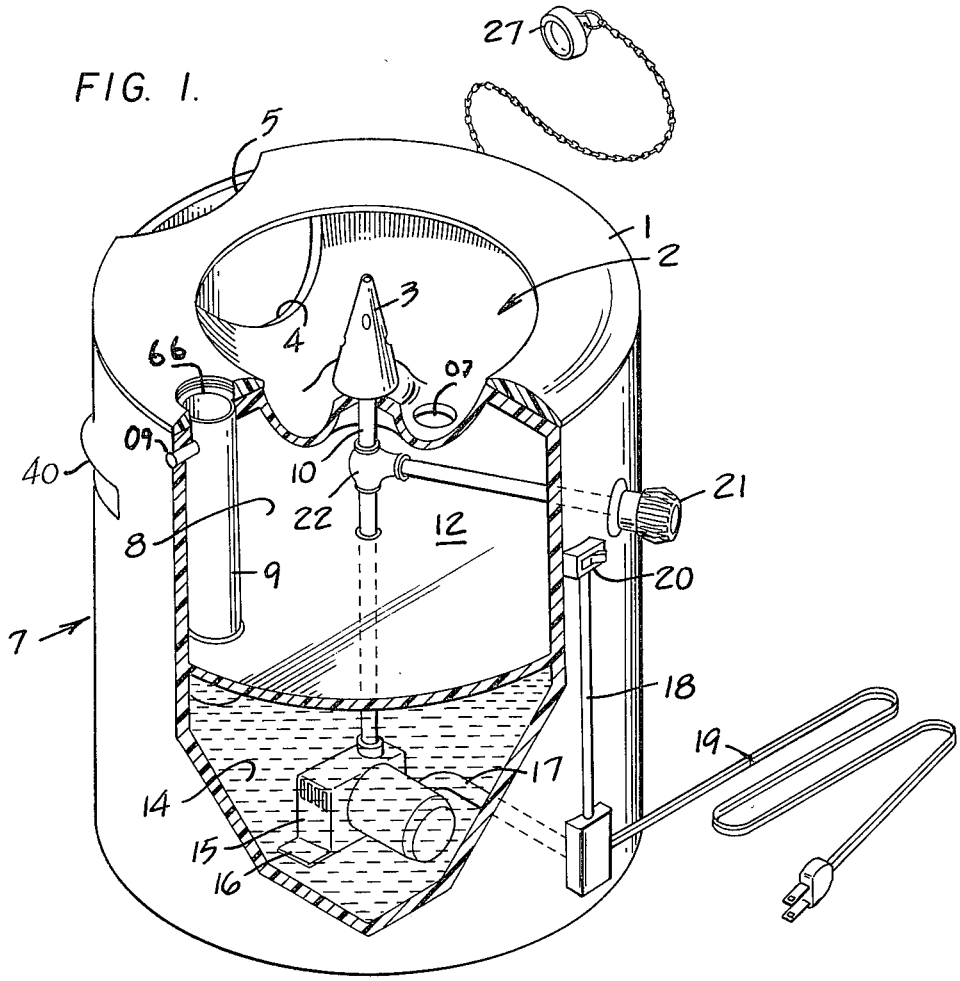
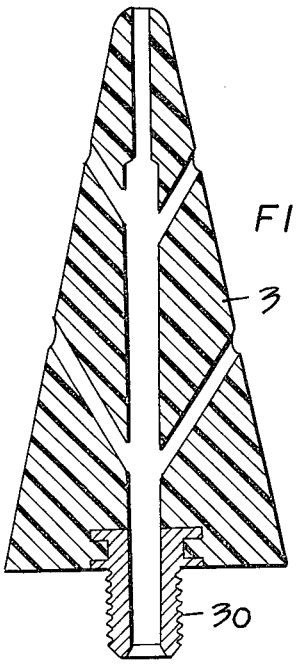
FIG. 2.
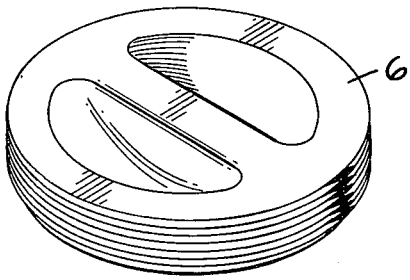
FIG 3.

ELECTRIC BIDET

RELATED APPLICATIONS

This application is a continuation of application Ser. No. 604,102 filed Aug. 13, 1975, now abandoned.

SUMMARY AND OBJECTIVES

Contemporary, permanently installed bidets being too expensive, too space hogging and too uncomfortable in usage for the limited services they offer; such as cold water with no means of adding medications or deodorants and having a hard, uncomfortable and a possible dangerous upright syringe are not popular. So called "portable bidets" being little more than a conglomeration of tedious attachments for mantling and dismantling on a commode, I have endeavored to produce a bidet which, after the first solution preparation, is instantly usable at hospital bedside, at home, on a boat or on a camper or plane, said bidet giving efficient douching, laving or enemasing service and needing no hookups or hang ups or clamps or seats or toilets; only an AC or DC electrical outlet.

DESCRIPTION OF THE FIGURES

FIG. 1 is a cutaway view of the bidet cabinet showing all of its features.

FIG. 2 is a cross sectional view of the douching syringe.

FIG. 3 shows the male threaded cap for the fill pipe.

DESCRIPTION

FIG. 1 shows an assembly of parts fitting into and dividing top from bottom a portable bidet cabinet 7 which contains and supports all parts of a full service bidet without other attachments, said assembly being a horizontal divider 12 having fill pipe 9 and a flow pipe 10 welded through said divider 12; said fill pipe 9 having vacuum preventive air vents 09 near the top end of said fill pipe 9 and flow pipe 10 having, interconnected, a flow control valve 22 with a handle 21.

Also shown in FIG. 1 is a wash and drain pan 2, being of ⅜ inch fiberglas stock, concaved molded 5 inches deep, round and 16 inches o.d. with a flat perimeter to rest on top of 16 inch o.d. cabinet 7, said pan 2 having a 2 inch center rise equating the height of the lip of a drain slot 4, and said equated level of lip and center rise retaining a 2 inch depth of wash water in said wash pan 2 while the center rise elevates syringe 3 out of said wash water.

The bidet seat 1 has a cut off back to form a waste dump slot 5 and a hole female threaded to receive fill pipe cover cap 6, said seat 1 being 16 inches o.d. and the inside opening being 10 inches diameter.

Referring to FIG. 2, shown is a cone shaped, hollow molded pliable resilient douching syringe; said syringe probably being molded of vinyl plastic and with five flow (jet) holes and being a center line length of 3½ inches with solid base being 1⅞ inches in diameter and the tip end (or top) being ⅜ inch in diameter, the male threaded connection 30 of said syringe 3 connects into female threaded top of flow pipe 10.

FIG. 3 shows the details of the male threaded fill pipe cap 6 which is received in the top female threaded end of the fill pipe 9.

Finally, FIG. 1 shows lugs 40 for carrying the appliance and the three-way AC-Off-DC electrical switch 20.

The bidet described in these drawings is constructed almost entirely of molded or extruded plastics, and following a probable route of assembly for manufacture, a round cabinet 7 is molded of ⅜ inch stock 18 inches high by 16 inches outside diameter with necessary small holes for receiving and sealing lead wire 17 and valve stem 22-21 through its walls.

A small, AC-DC wound, submersible electrical pump 15 is anchored in the bottom of the cabinet 7 by brace 16 and connected to line 17.

The assembly shown in FIG. 1 is constructed inside cabinet 7. The solution flow line 10 is connected to the outlet of the pump 15 first. Then the horizontal divider 12 is welded into sides of cabinet 7 at the halfway point. A 16 inch outside diameter 5 inches deep flat perimetered wash and drain pan 2 is secured on top of said cabinet 7. The fill pipe 9 extending into a hole 66 through said pan 2 and the flow pipe 10, extending through a hole at the apex of the center rise of pan 2 are welded in place. The top end of said flow pipe 10 is female threaded for receiving male threaded connection 30 of syringe 3. The wash-drain pan 2 also has a flush hole 07 for releasing fecal or other heavy matter into waste holding tank 8; a stopper 27 is provided for holding clean water in said wash-drain pan 2. A 2 inch center rise of said wash-drain pan 2 equates with the level of a back drain slot 4, elevating syringe 3 out of the two inches of wash water which the aforementioned drain barrier retains.

Seat 1 has 16 inch o.d., 10 inch inside diameter opening, ½ inch thick has a cut off back which forms a dump slot 5 from waste holding tank 8 and has a hole 66 for opening to fill pipe 9, said hole 66 being female threaded to receive male threaded cover. Said seat 1 being welded on top of wash-drain pan 2, said pan 2 being welded on top of cabinet 7.

Fill pipe 9 has its top end seated and welded in and around hole 66 being the bottom side of seat 1, and passes down and is sealed through divider 12, opening in fresh water tank 14, being 2¼ inch diameter for easy filling of fresh water tank 14. 18 qt. tank 14 may be filled by spigot, dipper, hose or whatever source of clean water, as wetting will not harm the motor or plastic appliances, only wire plug 19 must be kept dry.

I claim:

1. A portable bidet comprising in combination:

a. an integral hollow cylindrical structure having a bottom tank and a top tank, said top tank having an open end, said tanks both adapted to contain liquids;

b. a fountain pipe extending upwardly from the bottom tank through the top tank having a distal end proximate the open end of said top tank;

c. a basin structure mounted coaxially within said open end of said top tank, said basin structure having a concave bottom surface with a convex rise, said bottom surface having a hole defined therethrough coaxial with said convex rise, said fountain pipe extending through said hole, said basin structure also having an overflow port defined through its side whereby liquid may overflow from said basin into the top tank;

d. a toroidal seating surface having an inside diameter less than that of said open end of the top tank, said seating surface mounted coaxially on said open end of said top tank;

e. means for introducing a liquid into the bottom tank;

f. electrical means for pumping the liquid contained in the bottom tank through said fountain pipe, to direct a spray of liquid upwardly from the distal end of said fountain pipe proximate the open end of said top tank, said liquid being captured by said basin structure and then overflowing into said top tank.

2. The bidet of claim 1 further including a valving means for controlling flow of liquid from said fountain pipe.

3. The bidet of claim 1 wherein said convex rise in the bottom surface of said basin structure has a height equating that of the overflow port.

4. The bidet of claim 2 wherein said means for introducing liquid into the bottom tank comprises a fill pipe communicating into said bottom tank, said fill pipe having a distal end extending above said open end of said top tank, through an annular space defined between the side of the top tank and the basin structure, whereby a liquid may be poured into said bottom tank.

5. The bidet of claim 4 wherein said basin structure includes a circumferential lip structure integral with said toroidal seating surface engaging the open end of said top tank, said lip supporting said basin within said open end of the top tank, said lip structure having a pour spout cut therethrough, whereby, liquid in the top tank may be poured therefrom into an appropriate waste disposal facility.

6. The bidet of claim 5 wherein said circumferential lip structure and toroidal seating surface have a fill pipe hole cut therethrough for receiving said fill pipe, said fill pipe extending upwardly to a point flush with said seating surface.

7. The bidet of claim 3 further including (i) a solid waste disposal port communicating through the bottom surface of said basin structure, into the top tank and (ii) a removable plug adapted to be received by said solid waste disposal port, whereby solid wastes may be emptied from the basin structure into the top tank.

8. The bidet of claim 1 wherein said electrical means for pumping liquid from said bottom tank comprises a submergible electrical motor driving a submergible liquid pump, said motor and pump being secured to said fountain pipe.

9. The bidet of claim 7 wherein the hollow cylindrical structure, fountain pipe, basin structure and toroidal seating surface are composed of moldable materials from the class consisting of fiberglass and plastics.

10. The bidet of claim 7 wherein said distal end of said fountain pipe is adapted for receiving removable douching fixture.

11. The bidet of claim 10 wherein said douching fixture comprises a hollow, conical nozzle having a plurality of holes defined through its circumferential surface, and being adapted for connection to the fountain pipe at its base, said conical nozzle being composed of soft resilient and pliable materials from the class consisting of vinyl plastics, synthetic and natural rubbers and silicon rubbers.

* * * * *